United States Patent [19]

Nakamine

[11] 4,392,736

[45] Jul. 12, 1983

[54] ELECTRONIC COPYING APPARATUS FOR FORMING MULTIPLE IMAGES ON A SINGLE SHEET

[75] Inventor: Chosin Nakamine, Yokohama, Japan

[73] Assignee: Tokyo Shibaura Denki Kabushiki Kaisha, Kawasaki, Japan

[21] Appl. No.: 285,522

[22] Filed: Jul. 21, 1981

[30] Foreign Application Priority Data

Jul. 22, 1980 [JP] Japan ..... 55/99370

[51] Int. Cl.[3] ..... G03G 15/00

[52] U.S. Cl. ..... 355/3 R; 355/8

[58] Field of Search ..... 355/8, 14 R, 3 R, 11, 355/66, 3 TR

[56] References Cited

U.S. PATENT DOCUMENTS 4,074,934 2/1978 Satomi ..... 355/14 R

*Primary Examiner*—R. L. Moses

*Attorney, Agent, or Firm*—Cushman, Darby & Cushman

[57] ABSTRACT

An electronic copying apparatus comprises a device for holding a document to be copied, an optical scanning device for the document, a device which receives light reflected from the scanning device and forms a latent image of the document on a rotating photosensitive medium, a device for forming a toner image of the latent image, and a device for transferring the toner image on a copy paper. The document is intermittently scanned plural times, so that a plurality of the latent images of the document are formed at different positions corresponding to the respective scannings on the photosensitive medium in a continuous manner. A plurality of toner images corresponding to the plurality of latent images of the same document are transferred to a single copy paper.

4 Claims, 8 Drawing Figures

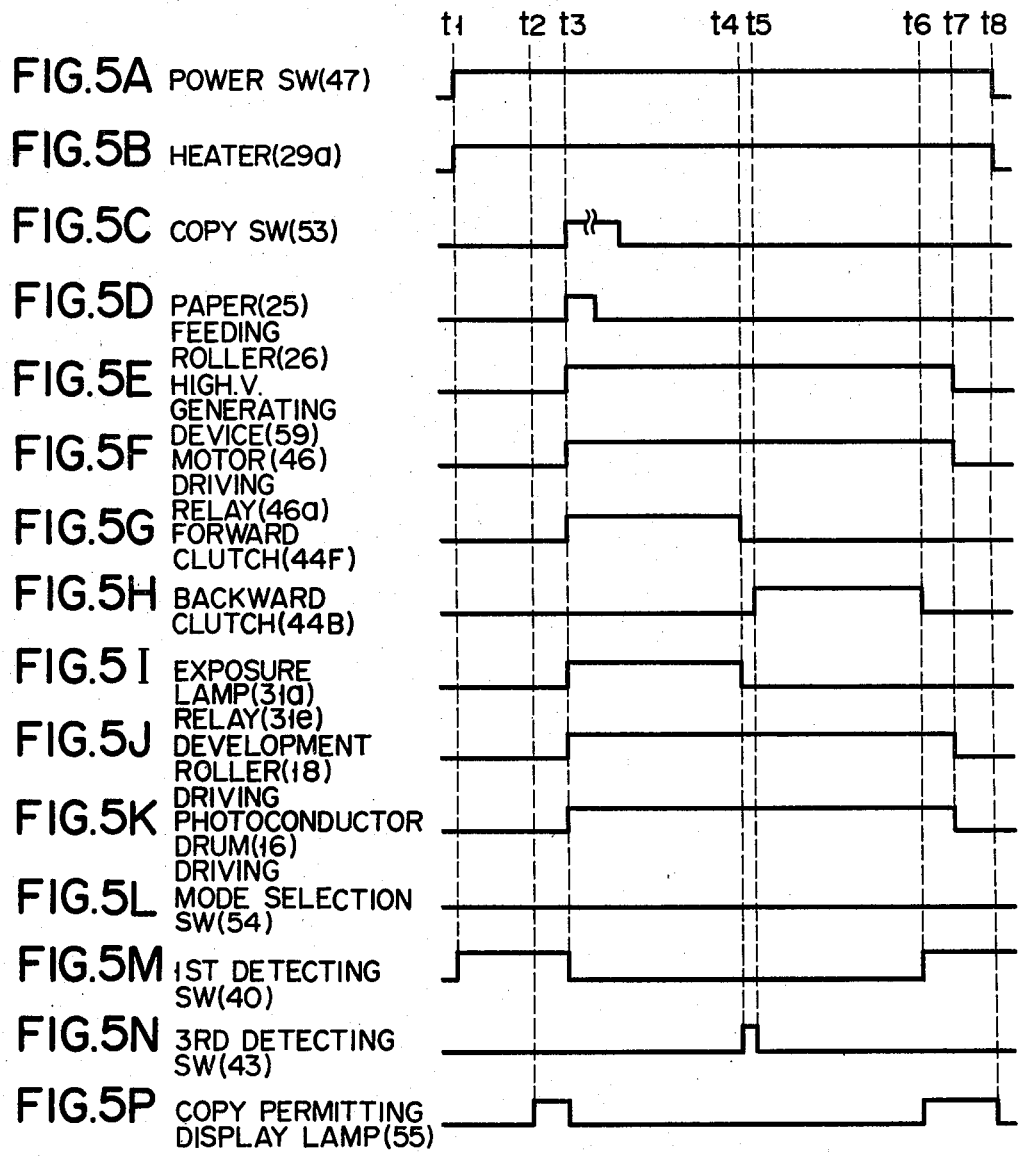
t1 t2 t3 t4 t5 t6 t7 t8
FIG.5A POWER SW(47)
FIG.5B HEATER(29a)
FIG.5C COPY SW(53)
FIG.5D PAPER(25) FEEDING ROLLER(26)
FIG.5E HIGH.V. GENERATING DEVICE(59)
FIG.5F MOTOR(46) DRIVING RELAY(46a)
FIG.5G FORWARD CLUTCH(44F)
FIG.5H BACKWARD CLUTCH(44B)
FIG.5I EXPOSURE LAMP(31a) RELAY(31e)
FIG.5J DEVELOPMENT ROLLER(18) DRIVING
FIG.5K PHOTOCONDUCTOR DRUM(16) DRIVING
FIG.5L MODE SELECTION SW(54)
FIG.5M 1ST DETECTING SW(40)
FIG.5N 3RD DETECTING SW(43)
FIG.5P COPY PERMITTING DISPLAY LAMP(55)

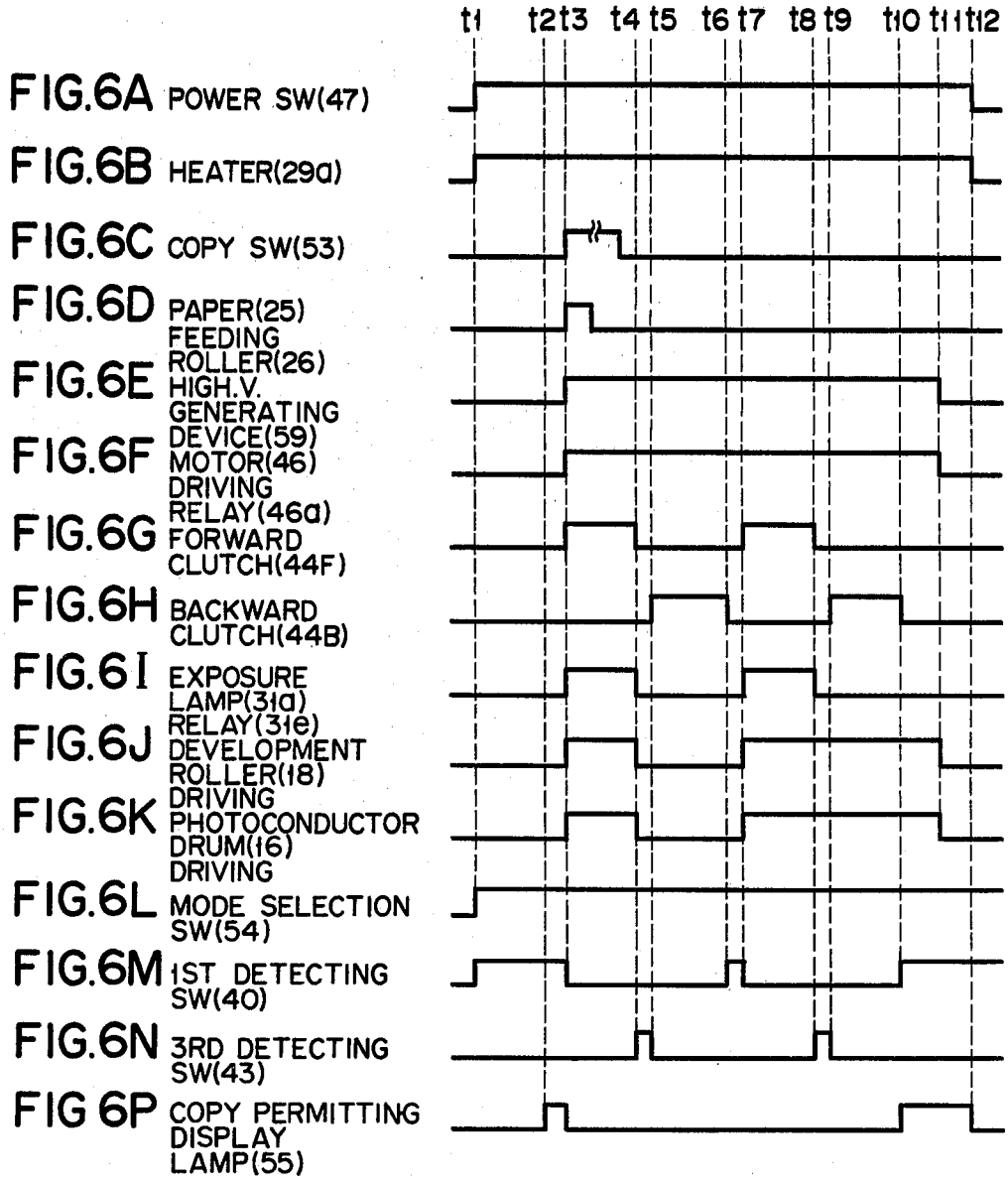
t1 t2 t3 t4 t5 t6 t7 t8 t9 t10 t11 t12
FIG.6A POWER SW(47)
FIG.6B HEATER(29a)
FIG.6C COPY SW(53)
FIG.6D PAPER(25) FEEDING ROLLER(26)
FIG.6E HIGH.V. GENERATING DEVICE(59)
FIG.6F MOTOR(46) DRIVING RELAY(46a)
FIG.6G FORWARD CLUTCH(44F)
FIG.6H BACKWARD CLUTCH(44B)
FIG.6I EXPOSURE LAMP(31a) RELAY(31e)
FIG.6J DEVELOPMENT ROLLER(18) DRIVING
FIG.6K PHOTOCONDUCTOR DRUM(16) DRIVING
FIG.6L MODE SELECTION SW(54)
FIG.6M 1ST DETECTING SW(40)
FIG.6N 3RD DETECTING SW(43)
FIG 6P COPY PERMITTING DISPLAY LAMP(55)

ELECTRONIC COPYING APPARATUS FOR FORMING MULTIPLE IMAGES ON A SINGLE SHEET

BACKGROUND OF THE INVENTION

The present invention relates to an electronic copying apparatus for forming a toner image of a document to be copied on a photosensitive medium.

An electronic copying apparatus of this type is generally classified into two types of the apparatus. One type of the copying apparatus forms a toner image of a document to be copied on a photosensitive medium, transfers the toner image to a copy paper, and then fixes the toner image transferred onto the copy paper, and then fixes the toner image transferred onto the copy paper. The other copying apparatus uses the photosensitive medium for a final copy paper. A toner image of the document is formed on the copy paper and is fixed theron. A description of a prior art copying apparatus of the former type, in which the toner image formed on the photosensitive medium is transferred onto the copy paper, will be given. The copying apparatus of this type is comprised of a document holding device for holding a document to be copied, a scanning device for scanning the document by relatively moving the document holding device and an exposure device, a latent image forming device for forming a latent image of the document on the photosensitive medium, a developing device for forming a toner image of the latent image, and a transfer device for transferring the toner image to a copy paper, and a fixing device for fixing the toner image on the copy paper. To complete one cycle of the copying operation, the document held on the document holding device is scanned one time by the scanning device. A single latent image corresponding to one time of scanning is formed by the latent image forming device. After the single toner image is transferred to a single copy paper, the toner image transferred is fixed on the copy paper. Thus, the toner image on the copy paper represents the image of the document corresponding to the one-time scanning.

There frequently occurs a situation that a number of documents of a much smaller area than that of the copy paper must be copied. In such a situation, if the small area document is copied by using the prior copying apparatus, the copy paper has a large useless space. To solve the useless space problem, a plurality of copied images formed through a plurality of transferring steps which produce the useless space on the copy paper are pasted together to form a new copy paper of a large area including a plurality of the copied images. The new document thus prepared must further be copied.

SUMMARY OF THE INVENTION

Accordingly, an object of the present invention is to provide an electronic copying apparatus which can form at least two images of the same document on a single copy paper without forming a new additional document.

According to one aspect of the invention, there is provided an electronic copying apparatus comprising: document holding means for holding a document to be copied at a given position; scanning means for optically scanning the document by relatively moving the document holding means and a light source of exposure means; latent image forming means which receives light reflected from the scanning means on a rotating photosensitive medium and forms a latent image of the document on the photosensitive medium; developing means for developing the latent image to form a toner image; transfer means for transferring the toner image onto a copy paper; and fixing means for fixing the toner image transferred on the copy paper; wherein the scanning means includes means for scanning the document held plural times intermittently, the latent image forming means includes means which is dislocated every scanning by the scanning means to form a plurality of latent images of the document on the photosensitive medium in a continuous manner; and the transferring means having means for transferring a plurality of the toner images of the document formed on the basis of the plural latent images on a single copy paper.

According to another aspect of the invention, there is provided an electronic copying apparatus comprising: document holding means for holding a document to be copied at a given position; scanning means for optically scanning the document by relatively moving the document holding means and a light source of exposure means; latent image forming means which receives light reflected from the scanning means on a single moving photosensitive medium and forms a latent image of the document on the photosensitive medium; developing means for developing the latent image to form a toner image; and fixing means for fixing the toner image transferred on the single photosensitive medium; wherein the scanning means includes means for scanning the document held by the holding means plural times intermittently, and the latent image forming means includes means which is dislocated every scanning by the scanning means to form a plurality of latent images of the document on the single photosensitive medium in a continuous manner.

Other objects and features of the invention will be apparent from the following description taken in connection with the accompanying drawings, in which:

BRIEF DESCRIPTION OF THE DRAWINGS

FIGS. 5A to 5P show an operation timing chart at respective portions when the copying apparatus shown in FIG. 3 operates in a normal mode;

FIGS. 6A to 6P show an operation timing chart at respective portions when the electronic copying apparatus operates in a multimode;

DETAILED DESCRIPTION OF THE PREFERRED EMBODIMENT

Figure 1:
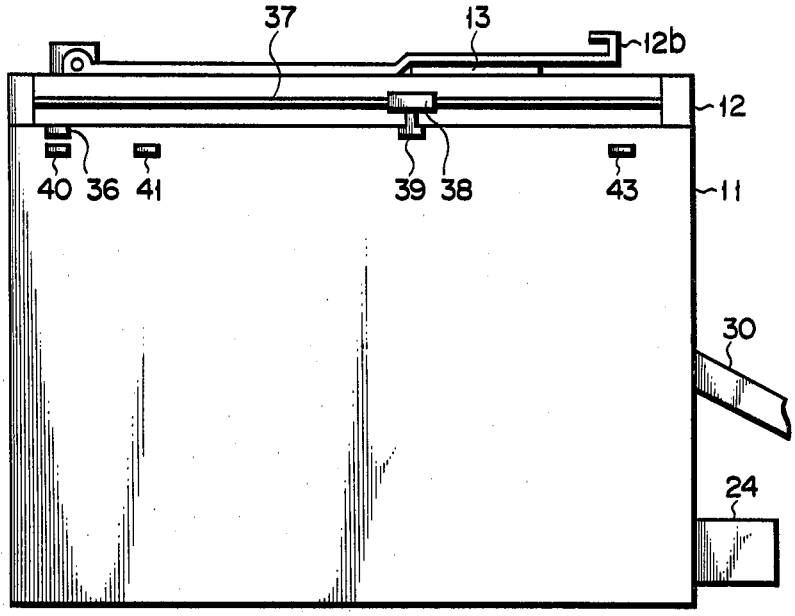
FIG. 1 is a side view of an embodiment of an electronic copying apparatus of the invention.
Figure 2:
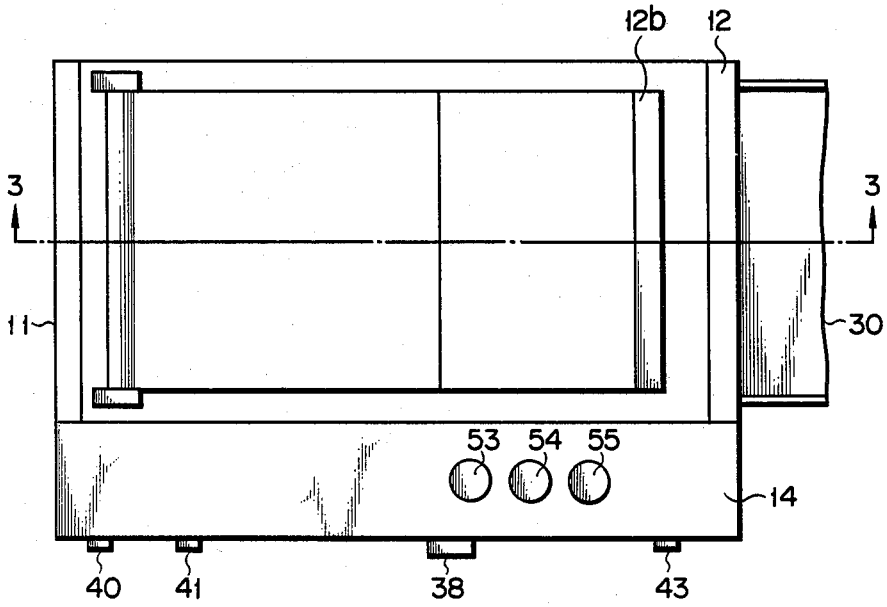
FIG. 2 is a plan view of the electronic copying apparatus shown in FIG. 1.
Figure 3:
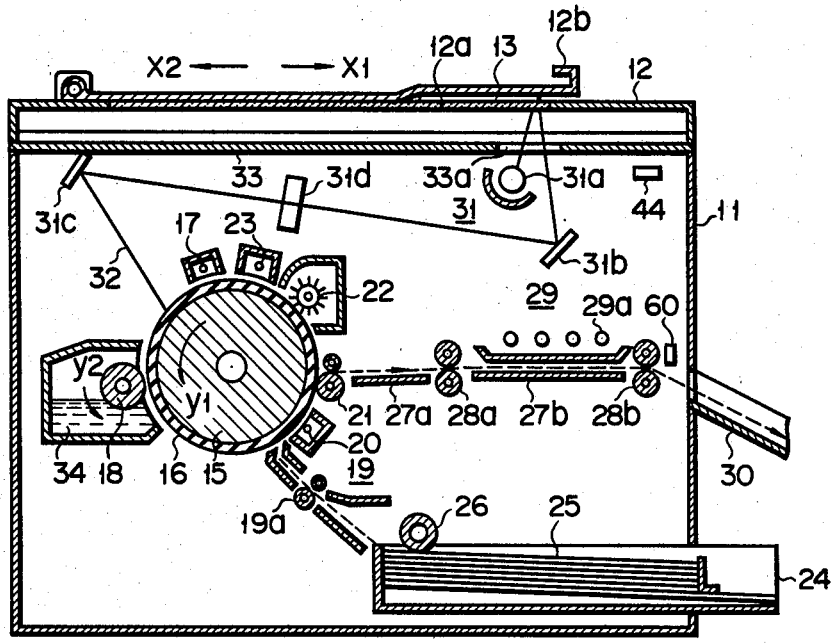
FIG. 3 is a longitudinal sectional view taken on line 3—3 in FIG. 2.

An embodiment of the present invention will be described referring to the accompanying drawings. In FIGS. 1 to 3, a document table 12 which is moved in arrowhead directions X1 and X2 is provided on an upper portion of a housing 11. A part 12*a* of the document table is formed by a glass plate. The part 12*a* is so arranged that a document 13 to be copied placed on the part 12*a* is covered by a document cover plate 12*b*. On an upper surface of a housing 11 is provided an operation panel 14 adjacent to the document table 12. A cylindrical rotatable drum 15 is provided in the housing 11, and is rotated about an axis. A photosensitive medium layer 16 is layered around the drum. The photosensitive medium layer 16 will be often referred to as a photoconductor drum, for simplicity of explanation. The photoconductor drum 16 is rotated in a direction y1. Around the photoconductor drum 16 are arranged a charging device 17, a developing roller 18, a copy paper guide device 19, a transfer device 20, a separation device 21, a cleaning device 22, and a charge removing device 23 in this order. Further, a paper supply cassette 24 is provided adjacent to an entrance of the copy paper guide device 19. A number of sheets of copy papers 25 stacked in the paper supply cassette 24 are taken out sheet by sheet every rotation of a paper feed roller 26, transferred to a guide roller 19*a* provided in the guide device 19, and further transferred to a surface of the photoconductor drum 16 as the guide roller 19*a* rotates. Adjacent to the separation device 21, guide plates 27*a* and 27*b* for guiding copied papers are provided. Transfer rollers 28*a* and 28*b* to transfer the copied paper are disposed at both ends of the guide plate 27*b*. A fixing device 29 including a heater 29*a* is provided above the guide plate 27*b*. Adjacent to the roller 28*b*, a paper discharge member 30 to take out the copied paper from the housing 11 is fixed to the housing 11. A scanning device 31 for optically scanning the document 13, that is, for exposing the document 13, is provided. The scanning device 31 includes an exposure lamp 31*a*, mirrors 31*b* and 31*c*, and a condenser 31*d*. A reflected light 32 from the document 13 is led to the surface of the photoconductor drum 16 by the device 31. A light shielding plate 33 is disposed between the housing 11 and the document table 12, having a slit 33*a* to allow light to transmit therethrough. The charging device 17, when impressed with high voltage, charges the surface of the photoconductor drum 16 with a positive charge. When the reflected light 32 illuminates the surface of the drum bearing the positive charge, the positive charge on the surface portion illuminated is neutralized. Therefore, a latent image of the positive charge is formed on the document 13. A container for the developing roller 18 contains a mixed powder of a carrier with a positive charge and a toner with a negative charge. The roller 18 accordingly applies the toner to the latent image having a positive charge while rotating in a direction of arrow y2. In other words, the latent image is developed. The transfer device 20, when impressed with positive voltage, applies the positive charge to the copy paper 25 which is moved at the same speed as a surface speed of the drum in contact with the drum surface, thereby transferring the toner image onto the copy paper 25. The copy paper with the toner image is separated from the surface of the drum by the separation device 21, and led onto the guide plate 27*a*. When it travels over the guide plate 27*b*, the toner image is fixed on the copy paper by the fixing device 29, and the copy paper with the fixed image is discharged from the paper discharge member 30. The cleaning device 22 is a rotatable brush which removes the toner residing on the drum 16. The charge removing device 23 removes the charge residing on the surface of the drum. The devices as mentioned above are publicly known.

The electronic copying apparatus of the present invention is provided with a means to reciprocate the document table 12 in directions of X1 and X2 one or plural times, as shown in FIG. 1. Specifically, a first magnet 36 is fixed at the left end of the document table 12 as viewed in the drawing, and a slidable knob 38 is mounted in a groove 37 formed in one side surface of the document table, which knob is manually slidable in the directions of X1 and X2 along the groove 37. A second magnet 39 is fixed to the knob. There are three switches fixed to the side surface of the housing 11; A first detector switch 40 disposed close to the first magnet 36 and a position illustrated which is an extreme position when the document table 12 is fully moved in the direction X2; A second detector switch 41 disposed at a distance of $l_0$ from the first detector switch 40; and A third detector switch 43 disposed near the right end of the document table 12 and substantially at the right end of the document 13. Hall elements or microswitches operated by the magnets 36 and 39 may be used for the detector switches 40, 41 and 43, respectively. The second detector switch 41 is a detecting switch for determining the number of reciprocations of the document table 12 when the table reciprocates plural times, and will be described in detail later referring to FIGS. 7 and 8. Further provided is a document table drive device 44 including a forward clutch 44F to drive the document table 12 in the direction of X1 and a backward clutch 44B to drive it in the direction of X2.

Figure 4:
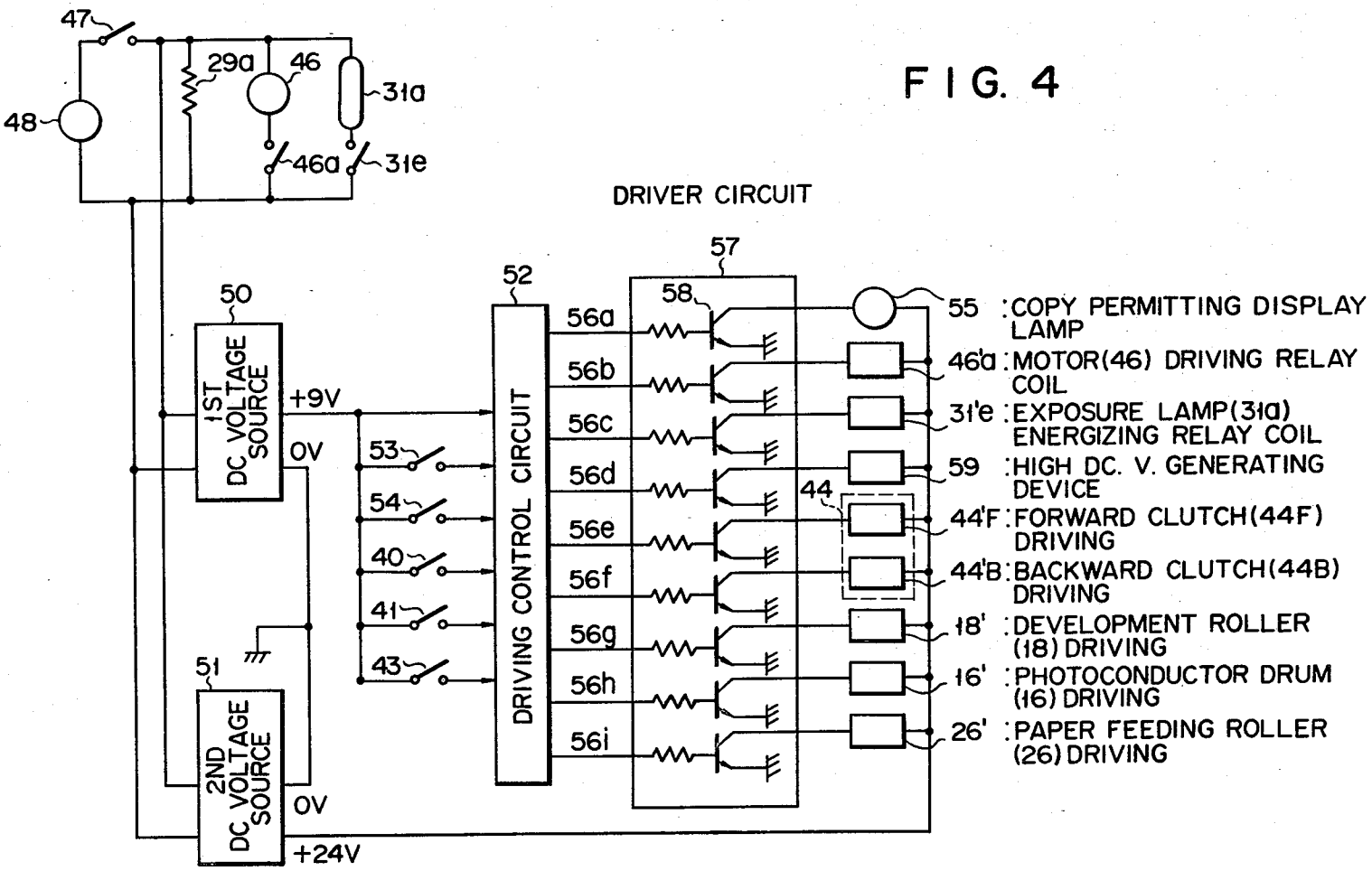
FIG. 4 shows, by way of block and circuit diagram, an electronic circuit of the electronic copying apparatus.

An electric circuit for driving an apparatus shown in FIG. 3 is illustrated in block form in FIG. 4. In the figure, a series circuit having a heater 29*a* of the fixing device 29, a driving motor 46, and a relay switch 46*a*, and another series circuit of the exposure lamp 31*a* and a relay switch 31*e* are connected between the terminals of an AC power source 48 by way of a power switch 47. An input terminal of a first DC power generating circuit 50 having output terminals of +9 V and 0 V and an input terminal of a second DC power generating circuit 51 having output terminals of +24 V and 0 V are connected across the AC power source via the power switch 47. The 0 V output terminal of the circuit 50 and the 0 V output terminal of the circuit 51 are earthed. Reference numeral 52 designates a drive control circuit of the apparatus shown in FIG. 3, and its input is supplied with a voltage of +9 V directly. The voltage +9 V is also applied to the input of the drive control circuit, via a copy start switch or copy switch 53, a mode selection switch 54 for selecting a normal operation mode or a multioperation mode, the first detector switch 41, and the third detector switch 43. Outputs 56*a* to 56*i* of the control circuit 52 are applied to a drive circuit 57 as inputs. Components 55, 46'*a*, 31'*e*, 59, 44'F, 44'B, 18', 16' and 26' are connected at one ends to the +24 V output terminal of the first DC power generating circuit 51. The other ends of the parts, respectively, are connected with corresponding terminals of the outputs 56*a* to 56*i* through transistors 58. The component 55 is an indication lamp for indicating a copy-ready condition. The component 46' is a drive coil for the relay 46*a*. The component 31'*e* is a drive coil for the relay 31*e*. The component 59 is a DC voltage generating circuit which applies a high DC voltage to the charging device 17 and the transfer device 20. The component 44'F is a drive coil for the forward clutch 44F. The component 44'B is a drive coil for the backward clutch 44B. The component 18' is a drive coil for a rotation control clutch of the developing roller 18. The component 16' is a drive coil for a rotation control clutch of the photoconductor drum 16. The component 26' is a drive coil for the rotation control of the feeding roller 26.

The copy start switch 53, the copy mode selection switch 54, the indication lamp 55 for indicating the copy-ready condition as described above are provided on the operation panel 14. It is desirable to install the power switch 47 at a location of the housing 11 where its operation is easy to do. Further, on the operation panel 14 are provided an operation monitoring device and a device for setting the number of copy papers, although not illustrated.

The driving control circuit 52 contains a given program, a waveform generating device for generating an output signal with a given waveform in accordance with the program, memories, a counter, etc. The copying operation of the copying apparatus shown in FIG. 3 when it is in a normal mode operation will be described referring to FIGS. 5A to 5P. The term "normal mode operation" means an operation mode in which a toner image of the document 13 formed when the document 13 is scanned one time by the scanning device 31, is formed on the single copy paper 25. The power switch 47 is turned on and the document 13 is placed on the document table 12, and the document is covered by the document cover plate **12*b*. The slidable knob 38 is slid to be in alignment with the left end of the document. In this case, the mode selection switch 54 may be OFF and therefore all an operator has to do is just to check whether it is OFF or not. Assume that the power switch 47 is turned ON at time t1 and turned OFF at time t8 (see FIG. 5A). On this assumption, when the heater 29*a* is activated during a period of time from time t1 to time t2, the fixing device 29 is ready for the fixing operation, so that the copy permitting display lamp 55 lights up at time t2 (FIG. 5P). At this time, the first detector switch 40 is ON (FIG. 5M). At time t3 after the lamp 55 lights, the copy start switch 53 (of the self-sustaining type) is actuated (FIG. 5C). Upon actuation of the start switch, the paper feeding roller 26 is rotated to feed the uppermost copy paper 25 of the stacked papers until its leading edge passes the guide roller 19*a* and reaches the drum surface (FIG. 5D). During a period from time t3 to t7, the DC voltage generating device 59 is driven (FIG. 5E), the relay switch 46*a* is turned on, the motor 46 is rotated (FIG. 5F), the relay 31*e* is turned on, the exposure lamp 31*a* is lit during a time period t3 to t4 (FIG. 5I), the developing roller 18 is rotated (FIG. 5J), and the rotation control clutch drive coil 16' of the photoconductor drum 16 is turned on to rotate the drum (FIG. 5K). In the normal operation mode, the mode selection switch 54 is left OFF (FIG. 5L). Since the drive coil 44'F for the forward clutch 44F is turned on during the period of time t3 to t4, the document table 12 moves in the direction X1 and stops at time t4 (FIG. 5G). The time t4 corresponds to a time point at which the second magnet 39 turns on the third detecting switch 43 (FIG. 5N). At the time point t3 at which the document table 12 starts to move in the direction X1, the first detector switch 40 is turned off (FIG. 5M). At time t5, the drive coil 44'B for the backward clutch 44B is driven, so that the document table 12 moves in the direction X2 and the third detector switch 43 is turned off (FIGS. 5H and 5N). At time t6, the document table 12 reaches a position shown in FIG. 1, the first detector switch 40 is turned on, and the document table 12 is stopped (FIGS. 5H and 5M). Since the exposure lamp 31*a* is deenergized at time t4, no latent image is formed on the drum when the document table 12 moves in the direction X2. At time t7, the DC voltage generating device 59, and the relay switch 46*a* are turned off and the developing roller 18 and the photoconductor drum 16 are stopped at their rotations (FIGS. 5E, 5F, 5J and 5K). At time point t8, the power switch 47 is turned off and therefore the heater 29*a* and the display lamp 55 are turned off. The operations of the respective components over a period of time from t3 to t7 is controlled by the program contained in the drive control circuit 52. In this control, the scanning speed of the document and the peripheral speed the photoconductor drum are of course synchronized with each other. From time t3, the charging device 17 starts to apply a positive charge to the surface of the photoconductor drum 16. Since the document table 12 is moved in the direction X1 during a time period t3 to t4 (FIG. 5G), the document 13 is scanned one time from the right end to the left end by means of the exposure lamp 31*a*. A latent image corresponding to the document 13 is formed on the drum surface with a positive charge by the reflected light 32. The latent image is developed into a toner image when the drum 16 passes the developing roller 18. The drum 16 continues its rotation in the direction y1 and the position of the toner image reaches the position of the transfer device 20. At this time, the copy paper 25 is fed in synchronism with the rotation of the drum 16 so as to reach the upper portion of the toner image. When the copy paper 25 passes the transfer device 20, a positive charge is applied onto the copy paper by means of the transfer device 20. Toner forming the toner image is attracted onto the copy paper. The copy paper 25 is separated from the drum surface by the separation device 21 and the toner image is fixed on the copy paper by the fixing device 29 when passing the guide plate 27*b* following the guide plate 27*a*. When the document table 12 is driven in the direction X1 and the second magnet 39 reaches the third detector 43, the backward clutch 44B operates at time t5, the document table 12 is driven in the direction X2, and comes to a standstill at the position shown in FIG. 1. On the other hand, the photoconductor drum 16 further continues its rotation. During the course of the rotation, residual toner is removed by the cleaning device 22, so that the charge still left on the drum is neutralized by the charge removing device 23**.

A multimode operation of the copying apparatus will be described. The "multimode operation" means that an operation mode in which an area of the document 13 is small and at least two images of the document 13 are formed on the same copy paper 25. In this mode, the document 13 is intermittently scanned at least two times by the scanning device 31 and at least two toner images formed by the scanning are transferred on a single copy paper 25 in a continuous manner. The waveforms or periods for driving the respective devices shown in FIG. 3 in this mode are illustrated in FIGS. 6A to 6P.

In the multimode operation, the power switch 47 is first turned on, the document 13 is placed on the document table 12, the document placed is covered by the document cover plate **12*b*. Then, the slidable knob 38 is slid and is aligned with left end of the document and the mode selection switch 54 is closed. Assume that the power switch 47 is turned on at time t1 and turned off at time t12 (FIG. 6A). On this assumption, when the heater 29***a* is heated during a period between time t1 to t2, the fixing device 29 is ready for the fixing operation at time t2, so that the copy permitting display lamp 55 lights at time t2 (FIG. 6P). At this time, the first detector switch 40 is in an ON state (FIG. 6M). At time t3 after the lamp 55 is lit, the copy start switch 53 is activated (FIG. 6C). Upon the activation of the switch, the paper feed roller 26 is rotated to feed the uppermost copy paper 25 until the leading edge of the copy paper passes the guide roller 19*a* to reach the drum surface (FIG. 6D). During a period from time t3 to t11, the DC voltage generating device 59 is driven (FIG. 6E) to turn on the relay switch 46*a* and to rotate the motor 46 (FIG. 6F). Further, the relay switch 31*e* is turned on to light the exposure lamp 31*a* (FIG. 6I). During a time period between t3 to t4, the drive coil 44'F of the forward clutch 44F is driven (FIG. 6G), the document table 12 is driven in the direction X1. During this period from time t3 to t4, the document 13 is first scanned by the scanning device 31. At time t4, the third detector switch 43 is turned on by the magnet 39 (FIG. 6N), so that the document table 12 is temporarily stopped at time t4 (FIG. 6G). During the time period from t3 to t4, the photoconductor drum 16 is rotated in the direction y1 (FIG. 6K) since the drive coil 16' for the drum drive clutch is energized. At the same time, the developing roller 18 is also rotated in the arrowhead direction y2, since the drive coil 18' is energized (FIG. 6J). Accordingly, during the period between time t3 to t4, the latent image of the document 13 formed on the drum surface is developed through the scanning during the period from time t3 to t4.

The rotation of the drum 16 is temporarily stopped at time t4 (FIG. 6K). At time t5, the drive coil 44'B for the backward clutch 44B is excited (FIG. 6H). Therefore, the document table 12 is moved in the direction X2. When the first magnet 36 reaches the first detector switch 40 at time t6, the first detector switch 40 is turned on (FIG. 6M) and the document table 12 temporarily stops. During the period that the document table 12 is driven in the direction X2, the exposure lamp is deenergized (FIG. 6I) and therefore the latent image is not formed. Since the drive coil 44'F of the forward clutch 44F is again excited (FIG. 6G), the document table 12 is again driven in the direction X1 and the document is secondly scanned. The second scanning is stopped at time t9 (FIG. 6N) that the third detector 43 is turned on by the second magnet 39. Since the drive coil 44'B of the backward clutch 44B is energized at time t9 (FIG. 6H), the document table 12 is driven in the direction X2. The document table 36 is stopped at time t10 that the first detector 40 is turned on. The photoconductor drum 16 and the developing roller 18 are continuously rotated over a period from time t7 to time t11 since the drive coils 16' and 18' are continuously energized from time t7 to t11. During the time period from time t7 to t8, the latent image formed on the drum surface through the second scanning during the period from t7 to t8 is developed. The copy paper which has been transferred to the drum surface and on standby, is transferred in synchronism with the rotational speed of the drum so that its leading edge coincides with the leading edge of the toner image. As referred to in the part of the description of the normal operation, toner forming the toner image is attracted onto the transfer paper by the transfer device 20. The toner image attracted is fixed onto the copy paper when it passes under the fixing device 29. This fixing process is similar to that in the normal mode operation. In the case of the multimode operation, as seen from FIGS. 6J and 6K, the rotation of the photoconductor drum 16 and the developing device 18 is stopped during a time period from time t4 to t7. Accordingly, the toner images formed by the first and second scannings are continuously formed on the drum surface. From this fact, it is seen that two toner images of the documents 13 are copied in a continuous manner on a single copy paper 25. Following the transferring process, the residual toner on the drum surface is removed by the cleaning device 22, and the residual charge is neutralized by the charge removing device 23. A time t11, the DC high voltage generating device 59, the motor relay 46*a*, the developing roller 18, and the photoconductor drum 16 are stopped. At time t12, the power switch 47 is turned off to thereby stop the energization of the heater 29*a*, and the copy permitting display lamp 55.

In the embodiment in the multimode operation, the operation during the period from time t2 to t11 is executed by the program set into the drive control circuit 52. While in the above-mentioned embodiment the document 13 is scanned only two times, the number of the scannings can be determined by automatically detecting a ratio of a length (a distance between the right and left ends of the copy paper 25) of the copy paper and a length (a distance between the right and left ends of the document 13) of the document. An exemplar of a means for determining the number of scannings will be described referring to FIGS. 7 and 8.

Figure 7:
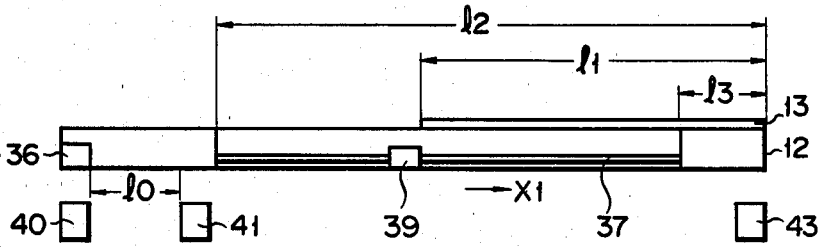
FIG. 7 shows a schematic diagram for illustrating the principle to determine the number of scannings of the document when the copying apparatus shown in FIG. 3 operates in the multimode.
Figure 8:
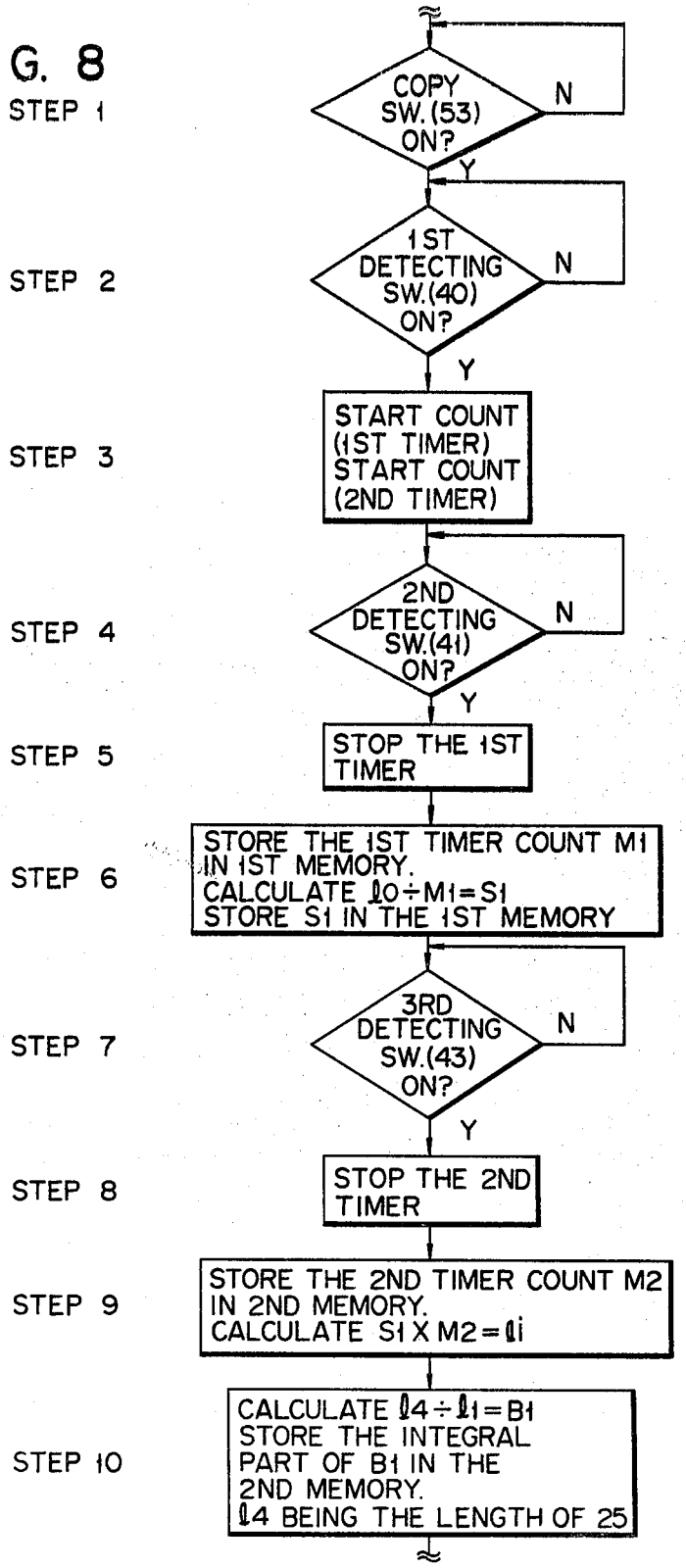
FIG. 8 is an operation flow chart for illustrating the scanning number determining principle shown in FIG. 7.

As shown in FIG. 7, the first detector switch 40, the second detector switch 41, and the third detector switch 43 are fixed to the side wall of the housing 11. The second detector switch, i.e. the switch for detecting a document table speed, is fixed distanced $l_0$ (mm) from the first detector switch 40. The second magnet 39 fixed to the slidable knob 38 is moved along the groove 37 to finally be aligned with the left end of the document 13. For this reason, the scanning number determining means under discussion is so designed that the image transfer of a document having the length shorter than a length $l_3$ is not performed in the embodiment. A length $l_2$ indicates a length of a document of which the copy is allowed. The principle of an automatic determination of the reciprocating number of the document table 13 will be described referring to FIGS. 7 and 8. The copy start switch 53 is now pushed. Upon pushing of the switch, the document table 13 is moved in the direction X1 (step 1). When the document table 13 leaves its fixed position, the first detector switch 40 is turned off (step 2). Provided in the drive control circuit 52 are a timer (first timer) for detecting a moving speed of the document table 12 and another timer (second timer) for detecting the length $l_1$ of the document 13 determined by the second magnet 39. When the first detector switch 40 is turned off, the first and second timers start their counting operation (step 3). When the first magnet 36 reaches the position of the second detector switch 41, the switch 41 is turned on (step 4). When the switch 41 is turned on, the first timer stops its counting operation (step 5) and its count M1 is stored in the first memory. Then, the $l_0/M1=S1$ is operated and the S1 is stored in the first memory (step 6). Assume now that $l_0=10$ mm and the count M1 is 5 sec. On this assumption, the speed of the document table 12 is: $10\div5=2$ mm/sec. Even after the detecting switch 41 is turned on, the document 12 still advances in the direction X1. When the second magnet 39 reaches the position of the third detector switch 43, then the third detector switch 43 is turned on (step 7). Then, the second timer stops its count and its count M2 is stored in the second memory. And the product, i.e. $l_1$ which is the product of S1 ($=l_0 \div M1$) calculated in the step 6 and the count M2, is obtained (step 9). When the count M2 is 30 sec, the length $l_1$ of the document 13 is calculated to be 2 mm$\times$30=60 mm. Since the length $l_4$ of the copy paper 25 is previously set in a third memory according to a size of the cassette or an external switch, $l_4 \div l_1$ may be calculated. Only the integer part of the result of the calculation is stored in the third memory (step 10). For example, in case where it is detected that the copy paper 25 is "A4" and its length $l_4$ of 297 mm is stored in the third memory, if the length $l_1$ is found to be 60 mm through the calculation in the step 9, $297 \div 60 = 4.95$ is calculated and only the integer part 4 is stored in the third memory. Accordingly, the document table 12 stops at the fixed position shown in FIG. 7 after it reciprocates four times. The number of reciprocations is determined when the third detector switch 43 is first turned on. The numerical value stored in the third memory is decreased by one every time the document table 12 reciprocates. When the numerical value stored in the third memory becomes zero, the document table 12 stops at the fixed position shown in FIG. 1.

As described above, according to the present invention, a plurality of images of the document 13 can be formed on a single copy paper 25. Therefore, a plurality of small individual images can be obtained by merely cutting the copy paper 25.

It should be understood that the present invention is not limited to the above-mentioned embodiment. The following copying method is known. Photoconductive material is applied over the surface of the copy paper and a positive charge is applied on the conductive material layer. Then, a latent image of the document is formed thereon. The latent image is developed to form a toner image and finally the toner image is fixed. The copying apparatus of the present invention may be applied to such known copying apparatus such that a plurality of toner images of a document are formed and fixed on a single copy paper. Although in the above-mentioned embodiment the document is scanned by moving the document table, what is essential is a relative movement between the document table and the exposure lamp. Further, for the multimode operation, the above-mentioned embodiment may be modified such that the number of the reciprocations of the document table is set by manually operating a plurality of push buttons additonally provided. In a further modification of the present invention, a detector 60 for detecting the trailing edge of the copy paper 25 is closely disposed downstream of the roller 28 provided downstream of the fixing device 29. After the lapse of a given time since the trailing edge is detected, the operation of the DC high voltage generating device 59 is stopped, the relay switch 46*a* is opened, and the photoconductor drum 16 and the developing roller are stopped in their rotation.

What is claimed is:

1. An electronic copying apparatus comprising:

document holding means for holding a document to be copied at a given position, light source means for exposing said document while being held, scanning means for optically scanning said document by relatively moving said document holding means and said light source means, latent image forming means which receives light reflected from said scanning means on a rotating photosensitive medium and forms a latent image of said document on said photosensitive medium, developing means for developing said latent image to form a toner image, transfer means for transferring said toner image onto a sheet of copy paper, and fixing means for fixing said toner image transferred onto said copy paper, wherein said scanning means includes means for scanning said document a plurality of times intermittently; said latent image forming means includes means for forming a plurality of latent images of said document on said photosensitive medium in a continuous manner so that every latent image is displaced on said photosensitive medium for every scanning; and said transferring means includes means for transferring a plurality of said toner images of said document formed on said photosensitive medium onto a single sheet of copy paper.

2. An electronic copying apparatus according to claim 1, wherein said means for scanning said document a plurality of times includes means for finding a ratio of a length of said single copy paper as viewed in a moving direction and a scanning length of said document; and means for optically scanning said document by the number corresponding to the value of an integer part of said ratio.

3. An electronic copying apparatus according to claim 2, wherein said photosensitive medium of said latent image forming means is rotated in synchronism with the optical scanning during the optical scanning operation of said document; and the rotation of said photosensitive medium is stopped between a first optical scanning period and a second optical scanning period succeeding to said first optical scanning period; and said photosensitive medium is rotated continuously for a given period of time without being stopped after a final optical scanning period is terminated.

4. An electronic copying apparatus according to claim 1, wherein said scanning means includes an operation mode selection switch for causing operation to transfer a plurality of images onto a single sheet of paper.

* * * * *